US007204487B1

(12) United States Patent
Pohl

(10) Patent No.: US 7,204,487 B1
(45) Date of Patent: Apr. 17, 2007

(54) BUMPER SOCCER

(76) Inventor: Andrew Pohl, 3 Redoubt St., Highland Falls, NY (US) 10928

( * ) Notice: Subject to any disclaimer, the term of this patent is extended or adjusted under 35 U.S.C. 154(b) by 286 days.

(21) Appl. No.: 11/016,180

(22) Filed: Dec. 18, 2004

Related U.S. Application Data

(60) Provisional application No. 60/530,460, filed on Dec. 18, 2003.

(51) Int. Cl.
*A63F 7/06* (2006.01)

(52) U.S. Cl. ..... 273/108.5; 273/108.1

(58) Field of Classification Search ..... 273/108.1, 273/108.5, 108.41, 239, 247, 242, 277, 288, 273/289, 290
See application file for complete search history.

(56) References Cited

U.S. PATENT DOCUMENTS 4,060,245 A 11/1977 Gamez Duch
4,350,343 A 9/1982 Salazar
5,046,743 A * 9/1991 Salerno ..... 273/247
5,092,595 A * 3/1992 Daravina ..... 273/108.5
5,242,164 A * 9/1993 Nicoll ..... 273/317.1
5,372,364 A * 12/1994 Arroyo ..... 273/108.5
5,431,397 A * 7/1995 Eckel et al. ..... 273/108.1
5,853,172 A * 12/1998 Yetken ..... 273/108.5
5,906,370 A 5/1999 Poisson
6,193,233 B1 * 2/2001 Lipman ..... 273/138.1

* cited by examiner

*Primary Examiner*—Nini F. Legesse

(57) ABSTRACT

A board game for at least two individuals to play. The board game is a modified form of soccer that uses roofing nails pounded into a flat surface as "players," a marble as a soccer ball, and a pair of Popsicle sticks as shooters. In addition, an elastic band is wrapped around into a rectangular fashion to have a rectangular-shaped playing field.

7 Claims, 2 Drawing Sheets

BUMPER SOCCER

I. CROSS-REFERENCE TO RELATED APPLICATIONS

This application claims the benefit of U.S. Provisional Application No. 60/530,460, filed Dec. 18, 2003.

II. BACKGROUND OF THE INVENTION

The present invention concerns that of a new and improved board game for at least two individuals to play.

III. DESCRIPTION OF THE PRIOR ART

U.S. Pat. No. 4,060,245, issued to Duch, discloses a soccer board game comprised of players representing two teams and a ball that is moved to toward a goal using a shooter chip comprised of a thin circular device with a semicircular outer edge.

U.S. Pat. No. 4,350,434, issued to Salazar and U.S. Pat. No. 5,906,370, issued to Poisson, disclose additional soccer board games for amusement purposes.

IV. SUMMARY OF THE INVENTION

The present invention concerns that of a new and improved board game for at least two individuals to play. The board game is a modified form of soccer that uses roofing nails pounded into a flat surface as "players," a marble as a soccer ball, and a pair of Popsicle sticks as shooters. In addition, an elastic band is wrapped around into a rectangular fashion to have a rectangular-shaped playing field.

There has thus been outlined, rather broadly, the more important features of a soccer board game that the detailed description thereof that follows may be better understood and in order that the present contribution to the art may be better appreciated. There are, of course, additional features of the soccer board game that will be described hereinafter and which will form the subject matter of the claims appended hereto.

In this respect, before explaining at least one embodiment of the soccer board game in detail, it is to be understood that the soccer board game is not limited in its application to the details of construction and to the arrangements of the components set forth in the following description or illustrated in the drawings. The soccer board game is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present soccer board game. It is important, therefore, that the claims be regarded as including such equivalent constructions insofar as they do not depart from the spirit and scope of the present invention.

It is therefore an object of the present invention to provide a soccer board game which has all of the advantages of the prior art and none of the disadvantages.

It is another object of the present invention to provide a soccer board game which may be easily and efficiently manufactured and marketed.

It is another object of the present invention to provide a soccer board game which is of durable and reliable construction.

It is yet another object of the present invention to provide a soccer board game which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
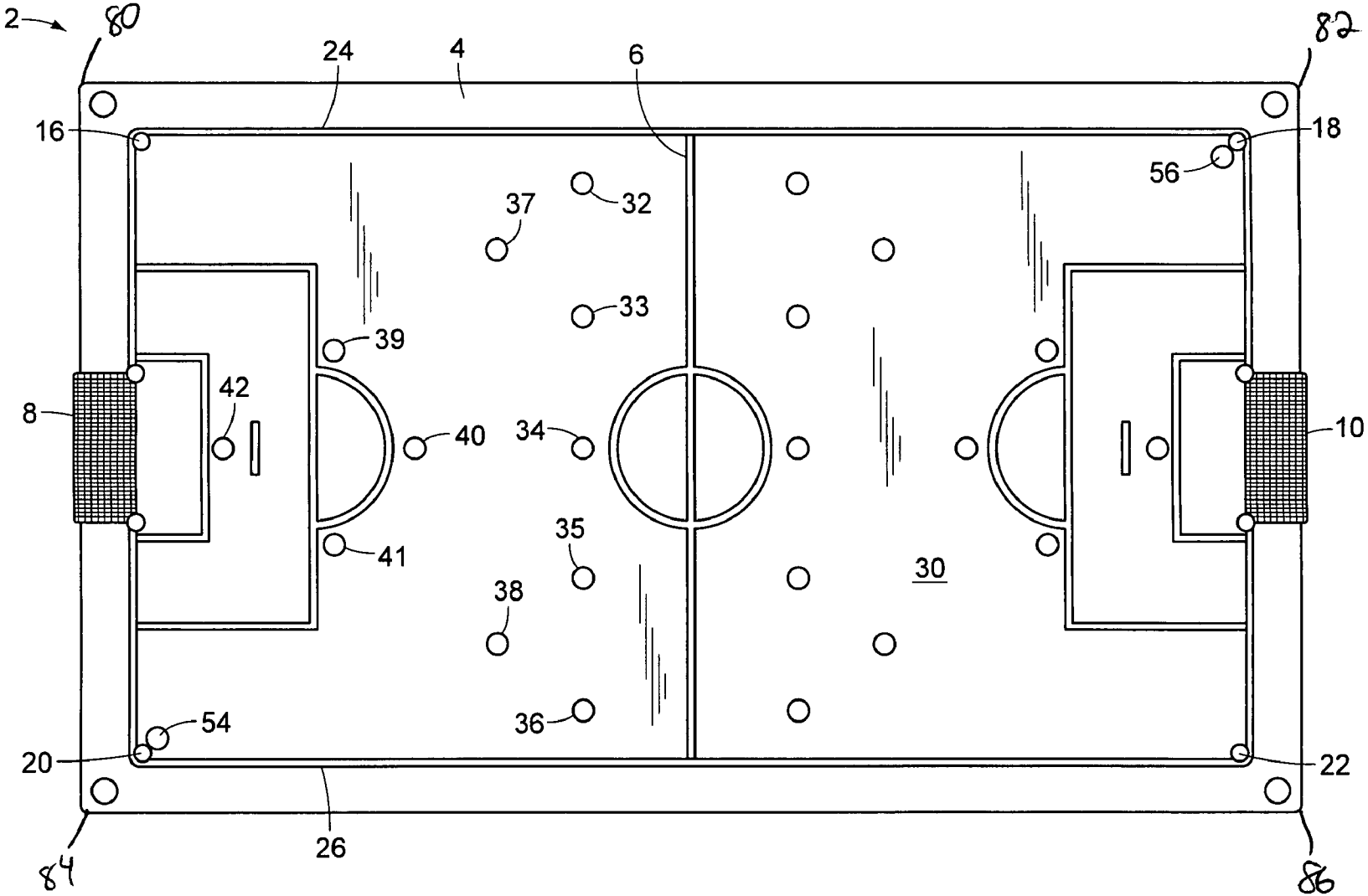
FIG. 1 shows a top view of the game board.

FIG. 1 shows a top view of the game board 2, which has a length and a width. Game board 2 itself has two ends, a first end and a second end, and two sides, a first side and a second side. Game board 2 is rectangular and has a top flat surface 4. Flat surface 4 has a center line 6 and has two goals 8 and 10, with goal area designations 12 and 14 marking off goals 8 and 10, respectively. The center line 6 travels from the first side to the second side of the game board 2 halfway in between the first end and the second end of the game board 2.

The game board 2 has four corners 80, 82, 84, and 86, and also has a quartet of mounting nails 16, 18, 20, and 22 which serve as the borders of the playing area, with each of the mounting nails located at one of the corners of the top flat surface 4 of the game board 2. Two separate elastic bands 24 and 26 are each wrapped around the two of the four mounting nails and each have two ends, a first end and a second end. Goals 8 and 10 are located near the first and second ends, respectively, of the game board 2. The first end of band 24 is attached to goal 8, wraps around nails 16 and 18, with the second end of band 24 attached to goal 10. The first end of band 26 is attached to goal 8, wraps around nails 20 and 22, with the second end of band 26 attached to goal 10.

The playing surface 30 within the elastic band 24 and 26 is preferably sixteen inches in length and nine and one-half inches in width. The playing surface 30 created by the elastic bands 24 and 26 has two ends, a first end and a second end, and two sides, a first side and a second side. Each of the two goals is open-faced on the side that faces the playing surface.

Center line 6 is straight line that travels from the first side of the elastic band 24 to the second side of the elastic band 24 about halfway between the two ends of the elastic band 24.

Each half of the playing surface 30 is designated for a particular "team" or player that is playing the board game 2. Each time has a total of thirteen "players," which actually are roofing nails pounded into the playing surface in specific locations.

Each side has five offensive players 32–36, two halfbacks 37–38, three defensive players 39–41, and a goalie 42. Offensive players 32–36 for each side are lined up in a linear row near the center line 6 and parallel to it. Halfbacks 37 and 38 for each side are lined up so that halfback 37 is further back from the center line 6 than the offensive players and is about halfway between offensive players 32 and 33. Halfback 38 is further back from the center line 6 than the offensive players and is about halfway between offensive players 35 and 36.

Goalie 42 for each side is located right in front of the goal for a particular "side." Defensive players 39, 40, and 41 are positioned in front of the goalie 42 so as to form a rough "diamond" shape.

Figure 2:
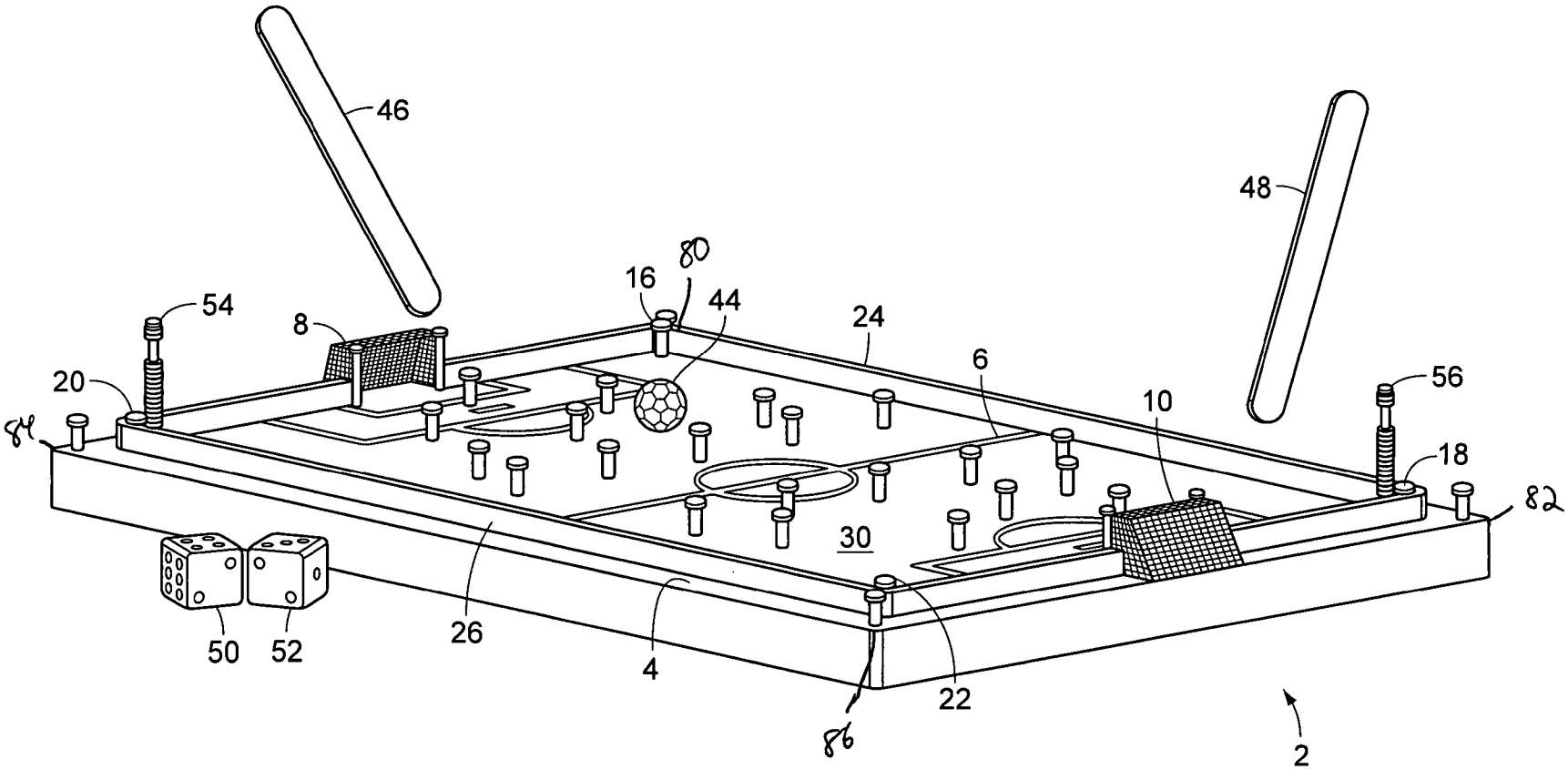
FIG. 2 shows a perspective view of the game board as it would appear in use.

FIG. 2 shows a perspective view of the game board as it would appear in use. Generally, a marble ball 44 is hit around with a pair of Popsicle sticks 46 and 48. Also, a pair of dice 50 and 52 can be used to help determine how many shots each player may proceed on their turn. A pair of scorekeepers 54 and 56 are used to keep score for keep individual playing the game.

I claim:

1. A board game comprising:

a game board having a length and a width, the game board having a first end, a second end, a first side, and a second side, the game board being rectangular and having a top flat surface, a center line located on the flat surface of the game board, the center line traveling from the first side to the second side of the game board halfway in between the first end and the second end of the game board, a pair of goals comprising a first goal and a second goal, the first goal being located at the first end of the game board, the second goal being located at the second end of the game board, the first goal and the second goal each having an open end, each open end having a first side and a second side, a quartet of mounting nails, each of the mounting nails being attached to a corner of the top flat surface of the game board, a playing surface located on the top surface of the game board, the playing surface being marked off by a defined border, the defined border being a first elastic band having a first end and a second end, the first end of the first elastic band attached to the first side of the open end of the first goal, the length of the first elastic band wrapped around the first nail and the second nail, and the second end of the first elastic band being attached to the first side of the open end of the second goal and a second elastic band having a first end and a second end, the first end of the second elastic band attached to the second side of the open end of the first goal, the length of the second elastic band wrapped around the third nail and the fourth nail, and the second end of the second elastic band being attached to the second side of the open end of the second goal, two sets of players, each set of players comprising a plurality of players fixedly attached to the playing surface of the game board in a fixed pattern, a first set of players being located on a first side of the center line and a second set of players being located on a second side of the center line, a game ball for use on the playing surface of the game board, a pair of objects for hitting the game ball around on the playing surface of the game board, means for determining how many hits each player gets when using an object to hit the game ball, and means for keeping score for each player when at least two individuals are playing the board game.

2. A board game according to claim 1 wherein each player attached to the playing surface of the game board is a mounting nail.

3. A board game according to claim 1 wherein the game ball used on the playing surface of the game board is a marble.

4. A board game according to claim 1 wherein the pair of objects for hitting the game ball around on the playing surface of the game board comprises a pair of sticks.

5. A board game according to claim 1 wherein the means for determining how many hits each player gets when using an object to hit the game ball comprises a pair of dice.

6. A board game according to claim 1 wherein the means for keeping score for each player when at least two individuals are playing the board game comprises a pair of scorekeepers mounted within the playing field.

7. A board game according to claim 1 wherein each set of players comprises thirteen fixed objects.

* * * * *